US008611801B2

(12) United States Patent
Nakamura et al.

(10) Patent No.: US 8,611,801 B2
(45) Date of Patent: Dec. 17, 2013

(54) FIXING APPARATUS AND IMAGE FORMING APPARATUS

(75) Inventors: Hirokazu Nakamura, Osaka (JP); Masaki Amemiya, Osaka (JP); Takashi Yamanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 364 days.

(21) Appl. No.: 13/043,603

(22) Filed: Mar. 9, 2011

(65) Prior Publication Data

US 2011/0229221 A1 Sep. 22, 2011

(30) Foreign Application Priority Data

Mar. 16, 2010 (JP) ..... 2010-059369

(51) Int. Cl.
*G03G 15/20* (2006.01)

(52) U.S. Cl.
USPC ..... 399/327; 399/123

(58) Field of Classification Search
USPC ..... 399/327, 123
See application file for complete search history.

(56) References Cited

U.S. PATENT DOCUMENTS 5,546,174 A * 8/1996 Hashizume et al. ..... 399/327
5,903,809 A * 5/1999 Tomatsu ..... 399/327
6,813,466 B1 * 11/2004 Kopecky ..... 399/351
7,062,212 B2 * 6/2006 Naruse et al. ..... 399/350
7,209,701 B1 * 4/2007 Kopecky ..... 399/351

FOREIGN PATENT DOCUMENTS

JP 60051869 A * 3/1985
JP 62-123486 A 6/1987

OTHER PUBLICATIONS

Machine translation of Abstract of reference Shimazaki (JP 60-051,869 A), Pub date Mar. 23, 1985.*

* cited by examiner

*Primary Examiner* — Walter L Lindsay, Jr.
*Assistant Examiner* — Rodney Bonnette
(74) *Attorney, Agent, or Firm* — Birch, Stewart, Kolasch & Birch, LLP

(57) ABSTRACT

The fixing apparatus is provided with a cleaning pad that is pressed against at least one of roller members composed of a fixing roller, a pressurizing roller and an external heating roller to clean a surface of the roller member, and the cleaning pad is composed of a pad member that cleans the surface of the roller member, and a support member that press the pad member against the surface of the roller member to support. The support member has a plurality of opening portions formed along a thrust direction of the roller member, and has a larger opening area per unit length of the support member at a center part of the support member than that at both edge parts thereof. For example, an interval of holes or slits is narrower at the center part of the support member than that at the both edge parts thereof.

8 Claims, 11 Drawing Sheets

FIXING APPARATUS AND IMAGE FORMING APPARATUS

CROSS-NOTING PARAGRAPH

This non-provisional application claims priority under 35 U.S.C. §119(a) on Patent Application No. 2010-059369 filed in JAPAN on Mar. 16, 2010, the entire contents of which are hereby incorporated herein by reference.

BACKGROUND OF THE INVENTION

1. Field of the Invention

The present invention relates to a fixing apparatus and an image forming apparatus, and more particularly to a fixing apparatus for fixing a toner image onto a recording sheet and an image forming apparatus including the fixing apparatus.

2. Description of the Related Art

An image forming apparatus by means of an electrophotographic method or the like is provided with a fixing apparatus for heating an unfixed toner image carried on a recording sheet so that the unfixed toner image is fixed onto the recording sheet. The fixing apparatus is composed of various rollers such as a fixing roller for heating the recording sheet, a pressurizing roller that is driven by the fixing roller to be rotated and has a nip portion formed between the fixing roller and itself, and further an external heating roller for heating the pressurizing roller.

Then, as a method for cleaning paper dust and the like attached to the surface of, for example, the fixing roller that constitutes the above-described fixing apparatus, a method for pressing a cleaning pad on the surface of the fixing roller is known. For example, Japanese Laid-Open Patent Publication No. 62-123486 describes a technique for giving a stronger pressing force of the cleaning pad to a downstream side than to an upstream side with respect to a rotational (radial) direction of the fixing roller in order to keep a pressure of the cleaning pad to the fixing roller constant, in a fixing apparatus.

Some of such cleaning pads are formed by attaching a heat-resistant felt, with a double-stick tape, to a support member such as a leaf spring having a square-U-shaped cross-section made of stainless steel, phosphor bronze or the like. The heat-resistant felt is pressed on the surface of the fixing roller with elastic force of the leaf spring to clean the surface of the fixing roller.

FIG. 10A to FIG. 10C are diagrams showing appearance of a support member that constitutes a conventional cleaning pad. FIG. 10A is a top view of the support member, FIG. 10B is a rear view of the support member, and FIG. 10C is a bottom view of the support member. In the diagrams, 100 denotes the support member. The support member 100 is pressed against a pressure-contacted roller such as a fixing roller or an external heating roller via heat-resistant felt, and used under a high-temperature environment, thus a strain due to thermal expansion occurs. Consequently, a plurality of holes or slits 100*a* (hereinafter, referred to as holes 100*a*) are formed equally at even intervals at a bending portion of the leaf spring folded back so as to have a square-U-shaped cross-section along a long side (thrust) direction of the pressure-contacted roller, and the plurality of holes 100*a* make it possible to suppress thermal expansion.

FIG. 11 is a diagram showing a distribution state of a surface temperature of the pressure-contacted roller against which the cleaning pad is pressed. In the diagram, a longitudinal axis shows the surface temperature in a thrust direction of the pressure-contacted roller, and a lateral axis shows a position in the thrust direction of the pressure-contacted roller. In this manner, since the surface temperature of the pressure-contacted roller is higher at a center part compared to both edge parts, the cleaning pad pressed against the pressure-contact roller tends to have a greater thermal expansion and easily have a larger strain at the center part compared to the both edge parts. And, since the contact pressure of the cleaning pad against the pressure-contacted roller is changed in the thrust direction due to the strain, problems such as cleaning defection, unevenness of cleaning have occurred, and caused a problem to contaminate a recording sheet.

On the other hand, the technique described in the above Japanese Laid-Open Patent Publication No. 62-123486 aims to stabilize the contact pressure of a cleaning pad with respect to a radial direction of a fixing roller, however, considerations are not made for stabilizing the contact pressure with respect to a thrust direction of the fixing roller. Namely, it is impossible to suppress thermal expansion with respect to the thrust direction of the fixing roller.

Additionally, it is considered that a suppression effect on a thermal expansion is approximately the same at a center part in which the thermal expansion is great and at both edge parts in which the thermal expansion is small, when a plurality of the holes 100*a* are equally formed at even intervals in a long side direction of the bending portion like the support member 100 shown in FIG. 10A to FIG. 10C. Consequently, even though it is possible to suppress the thermal expansion at the both edge parts in which the thermal expansion is small by means of the holes 100*a*, it may be impossible to sufficiently suppress the thermal expansion at the center part in which the thermal expansion is great. Thus, a residual strain due to the thermal expansion may occur at the center part of the support member 100.

SUMMARY OF THE INVENTION

An object of the present invention is to provide a fixing apparatus capable of appropriately suppressing thermal expansion of a support member that constitutes a cleaning pad with respect to a thrust direction of a pressure-contacted roller that is pressed against the cleaning pad, and an image forming apparatus including the fixing apparatus.

Another object of the present invention is to provide a fixing apparatus that heats a recording sheet on which an unfixed toner image is held by sandwiching it in a nip portion formed between a pair of rollers so that the unfixed toner image is melted to be fixed onto the recording sheet, comprising: a cleaning pad that is pressed against at least one of roller members including the pair of the rollers to clean a surface of the roller member, wherein the cleaning pad is composed of a pad member that cleans the surface of the roller member and a support member that supports the pad member by pressing it against the surface of the roller member, and the support member has a plurality of opening portions formed along a thrust direction of the roller member, and an opening area per unit length of the support member is larger at a center part of the support member than that at both edge parts thereof.

Another object of the present invention is to provide the fixing apparatus, wherein the roller member is composed of a fixing roller, a pressurizing roller that is coupled with the fixing roller and an external heating roller that heats the pressurizing roller, and the cleaning pad is pressed against at least one roller of the fixing roller, the pressurizing roller and the external heating roller to clean the surface of the roller.

Another object of the present invention is to provide the fixing apparatus, wherein the plurality of the opening portions are composed of holes or slits, and an interval of the holes or the slits is narrower at a center part of the support member than that at both edge parts thereof.

Another object of the present invention is to provide the fixing apparatus, wherein the plurality of the opening portions are composed of holes or slits, and a width of the hole or the slit is wider at a center part of the support member than that at both edge parts thereof.

Another object of the present invention is to provide the fixing apparatus, wherein the support member includes a bending portion that is folded back so as to have a square-U-shaped cross-section or a cross-section having a shape like a kana "he" character (L-shaped), and the plurality of the opening portions are formed in a long side direction of the bending portion.

Another object of the present invention is to provide the fixing apparatus, wherein the support member includes the bending portion that is folded back so as to have a square-U-shaped cross-section or a cross-section having a shape like a kana "he" character (L-shaped) and a pad member fixation portion that is provided to be extended from the bending portion and fixes the pad member, and the plurality of the opening portions are composed of holes that are formed at a regular interval and in a constant width in the long side direction of the bending portion and slits that are formed in a long side direction of the pad member fixation portion, and an interval of the slits is narrower at a center part of the pad member fixation portion than that at both edge parts thereof.

Another object of the present invention is to provide the fixing apparatus, wherein the support member includes the bending portion that is folded back so as to have a square-U-shaped cross-section or a cross-section having a shape like a kana "he" character (L-shaped) and the pad member fixation portion that is provided to be extended from the bending portion and fixes the pad member, and the plurality of the opening portions are composed of slits formed in the long side direction of the pad member fixation portion, and an interval of the slits is narrower at a center part of the pad member fixation portion than that at both edge parts thereof.

Another object of the present invention is to provide an image forming apparatus including the fixing apparatus.

DETAILED DESCRIPTION OF THE INVENTION

Hereinafter, a description of embodiments of a fixing apparatus and an image forming apparatus including the fixing apparatus of the present invention will be given with reference to the accompanying drawings.

Figure 1:
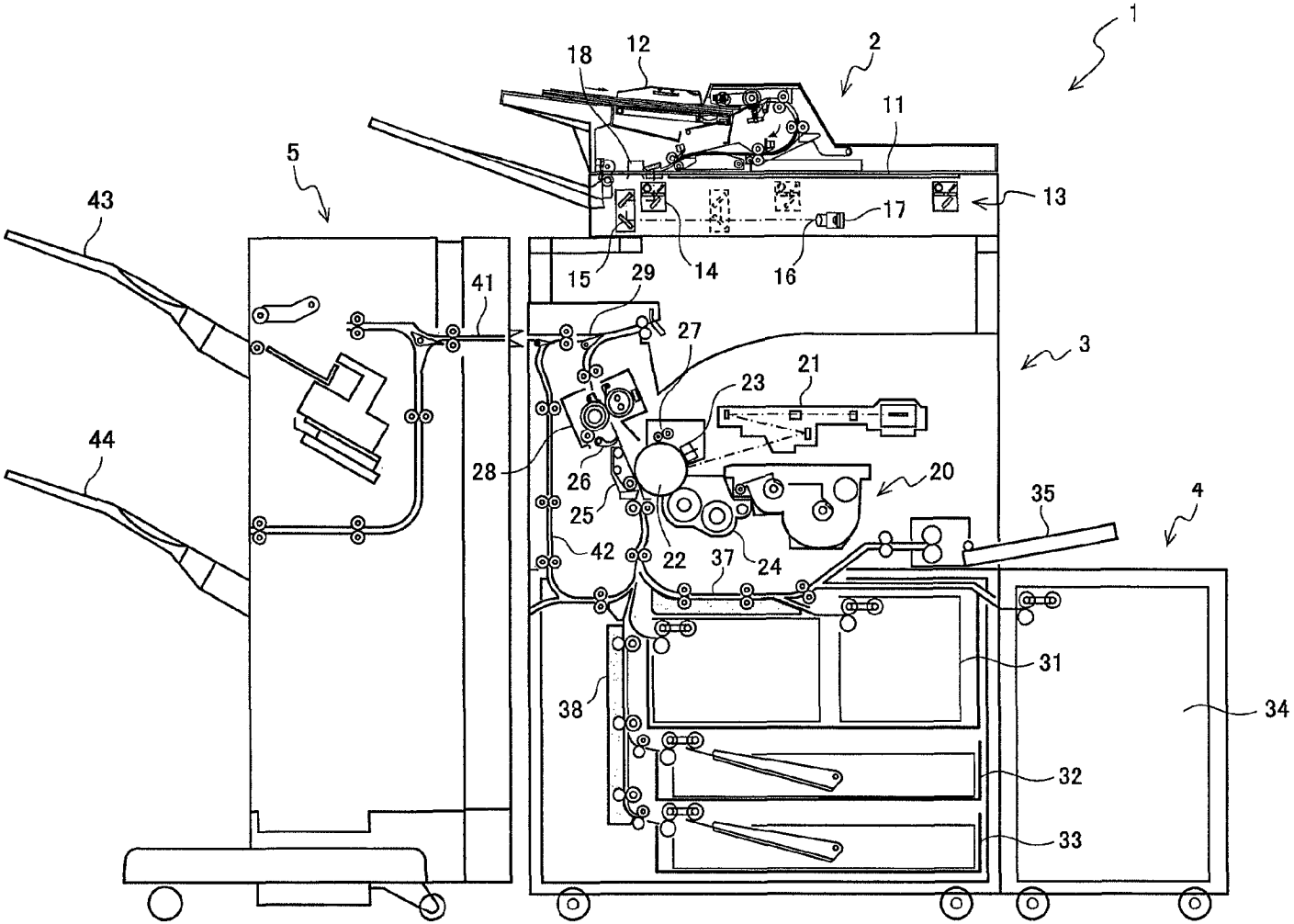
FIG. 1 is a diagram showing a configuration example of an image forming apparatus that employs a fixing apparatus according to the present invention.

FIG. 1 is a diagram showing a configuration example of an image forming apparatus that employs a fixing apparatus according to the present invention, and in the diagram, 1 denotes the image forming apparatus. An image forming apparatus 1 is roughly composed of an image reading portion 2, an image forming portion 3, a paper feeding portion 4 and a paper discharge portion 5. The image reading portion 2 is composed of a document platen 11 made of transparent glass, a reversing automatic document feeder (RADF) 12 for automatically supplying a document onto the document platen 11, and a document image reading unit, that is, a first scanner unit 13, for scanning and reading an image of the document placed on the document platen 11.

The first scanner unit 13 is composed of a lamp reflector assembly that exposes a document surface, a first scan unit 14 equipped with a first reflective mirror for guiding an optical image reflected from the document to a photoelectric conversion element (CCD) 17 that converts the optical image reflected from the document into an electric image signal, a second scan unit 15 equipped with a second and a third reflective mirrors, and an optical lens body 16 for forming the optical image reflected on the CCD 17. As indicated by broken lines in FIG. 1, the first scan unit 14 travels at a constant speed V from left to right along the document platen 11, and the second scan unit 15 is subjected to scanning control so as to travel at a V/2 speed in the same direction.

An RADF 12 is a known apparatus for automatically feeding a plurality of documents, sheet by sheet, which have been set on a predetermined document tray at a time onto the document platen 11 of the first scanner unit 13. Then, a front face of the fed document is read by the first scan unit 14 fixed at a position indicated by a solid line in FIG. 1, and a back face of the document is read by a second scanner unit 18. The RADF 12 is configured so that one surface of the document, at the time of being read corresponding to selection of a user, is read by the first scanner unit 13, and when both surfaces of the document are read, the front face of the document is read by the first scanner unit 13, and the back face of the document is read by the second scanner unit 18 at one document conveyance.

Whereby, in the image reading portion 2, a sheet document is read by sequentially feeding a document to be read onto the document platen 11 with related operations of the RADF 12, the first scanner unit 13 and the second scanner unit 18, while in the case of a book document, it is placed on the document platen 11, and the first scanner unit 13 is moved along a lower surface of the document platen 11 to sequentially form an image of the document placed on the document platen 11 on the CCD 17 line by line, and a document image is read.

Image data obtained by reading the document image with the first scanner unit 13 is once stored in a memory after variously processed, and the image data is output from the memory to the image forming portion 3 in response to an output instruction, then reproduced on a photoreceptor drum 22 as a visible image, thereafter the image is transferred onto a sheet to form a toner image.

The image forming portion 3 is provided with a laser scanning unit (LSU) 21 and an electrophotographic process portion 20. The laser scanning unit 21 includes a semiconductor laser that emits a laser beam corresponding to image data read from the memory or image data transferred from an external device such as a personal computer, a polygon mirror that deflects the laser beam at an equiangular speed and a f-θ lens that corrects so that the laser beam deflected at the equiangular speed scans at a uniform speed on the photoreceptor drum 22 of the electrophotographic process portion 20. The electrophotographic process portion 20 has a structure that, according to a known aspect, a charging apparatus 23, a developing apparatus 24, a transfer apparatus 25, a peeling apparatus 26, a cleaning apparatus 27 and a neutralization apparatus are arranged around the photoreceptor drum 22, and further a fixing apparatus 28 according to the present invention is arranged on a downstream side of the photoreceptor drum 22.

The paper feeding portion 4 includes a first cassette 31 to a third cassette 33, a manual feeding tray 35 and further a large volume cassette 34 as an optional extra. The first cassette 31 is a tandem tray that contains a first tray and a second tray, and it is possible to pull out both trays together from the apparatus body. The second cassette 32 and the third cassette 33 contain a third tray and a fourth tray, respectively. In other words, four trays are contained in three cassettes (31 to 33). Since the large volume cassette 34 is a large volume tray (fifth tray), it is able to contain the most frequently-used, for example, A4-size standard sheet. Paper feeding conveyance portions 37 and 38 are provided with a paper feeding roller, a conveying roller and a registration roller in order to convey a sheet from the paper feeding portion 4 to a transfer position between the photoreceptor drum 22 and the transfer apparatus 25.

The four trays in the first cassette 31 to the third cassette 33 and the large volume cassette 34 provided in the paper feeding portion 4, contain the sheets piled on a size to size basis, and when a user selects a cassette or a tray in which a desired sized sheet is contained, each sheet is fed from the top of a batch of sheets in the tray, and sequentially conveyed to the electrophotographic process portion 20 through conveyance paths of the paper feeding conveyance portions 37 and 38.

In the laser scanning unit 21 and the electrophotographic process portion 20, the image data read from the memory is scanned with a laser beam by the laser scanning unit 21 to be formed on a surface of the photoreceptor drum 22 as an electrostatic latent image and a toner image visualized by a toner of the developing apparatus 24 is electrostatically transferred with the transfer apparatus 25 onto a surface of the sheet conveyed from the paper feeding portion 4, then fixed by the fixing apparatus 28.

A paper discharge path 29 is provided on a downstream side in a paper conveyance direction of the fixing apparatus 28, and the paper discharge path 29 is branched into a paper discharge conveyance path 41 of the paper discharge portion 5 and a conveyance portion 42 for duplex copying.

The recording sheet on which an image is formed in this manner is sent from the fixing apparatus 28 to the paper discharge portion 5, or selectively conveyed to the conveyance portion 42 for duplex copying. The sheet sent to the paper discharge portion 5 is subjected to predetermined processing such as sort or staple processing as needed, and is stacked on a first discharge tray 43 or a second discharge tray 44. Moreover, a sheet sent to the conveyance portion 42 for duplex copying is reversed here to be conveyed to the electrophotographic process portion 20 again, and an image is formed on a back side of the sheet, then discharged after fixation.

<Fixing Apparatus>

Figure 2:
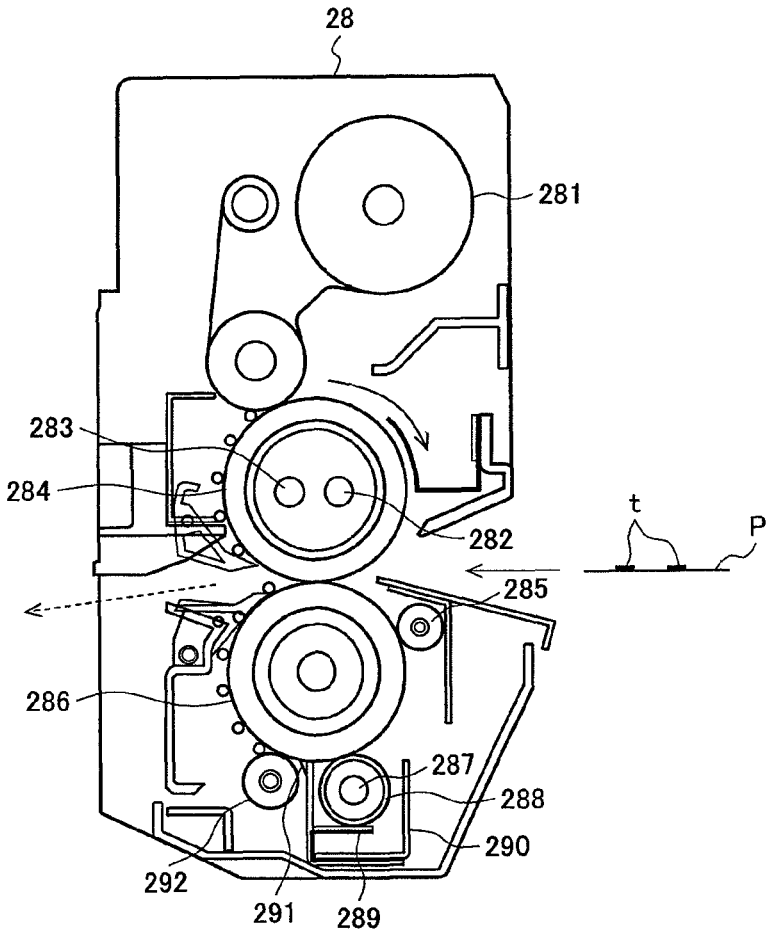
FIG. 2 is a diagram showing a configuration example of the fixing apparatus according to the present invention.

FIG. 2 is a diagram showing a configuration example of the fixing apparatus 28 according to the present invention. The fixing apparatus 28 is provided with a cleaning web 281, a main heater lamp 282, a sub-heater lamp 283, a fixing roller 284, a first cleaning roller 285, a pressurizing roller 286, an external heating heater lamp 287, an external heating roller 288, a cleaning pad 289, an external heating frame 290, a static elimination brush 291 and a second cleaning roller 292.

The fixing roller 284 incorporates two heater lamps which are different in light distribution (main heater lamp 282 whose light is distributed to the center, sub-heater lamp 283 whose light is distributed to both edge parts). The external heating roller 288 incorporates the external heating heater lamp 287. For these three heater lamps (282, 283 and 287), for example, halogen lamps or the like are able to be used.

The pressurizing roller 286 is pressed against the fixing roller 284 so that a nip portion is formed between the fixing roller 284 and the pressurizing roller 286. A periphery of the external heating roller 288 comes into contact with a periphery of the pressurizing roller 286, and the surface of the pressurizing roller 286 is warmed by heat of the external heating roller 288. An unfixed toner image t is fixed onto a recording sheet P with thermal pressure by passing the recording sheet P on which the toner image (unfixed toner image t) electrostatically transferred by the transfer apparatus 25 is held through between the fixing roller 284 and the pressurizing roller 286.

In this case, the surface of the fixing roller 284 is cleaned by the cleaning web 281. The surface of the pressurizing roller 286 is cleaned by the first cleaning roller 285 and the second cleaning roller 292. The surface of the external heating roller 288 is cleaned by the cleaning pad 289. Note that, needless to say, the cleaning pad 289 may be used also for cleaning the surface of the fixing roller 284 or the pressurizing roller 286.

In a state where the fixing apparatus 28 is equipped in the body of the image forming apparatus 1, a gear (not shown) of a driving mechanism on the side of the body of the apparatus is engaged with a gear (not shown) of a shaft of the fixing roller 284, rotary drive force from the driving mechanism (not shown) on the side of the body of the apparatus is transmitted to the shaft of the fixing roller 284, and the fixing roller 284 is rotationally driven in the direction of the arrow of the diagram. The pressurizing roller 286 is driven to be rotated by the fixing roller 284. The recording sheet P is sandwiched in the nip portion between the fixing roller 284 and the pressurizing roller 286 to be conveyed, then heated and pressurized. Thereby, the unfixed toner image t on the recording sheet P is melted, mixed, pressed and heat fixed. The external heating roller 288 rotates along with the pressurizing roller 286.

By energizing two heaters (main heater lamp 282, sub-heater lamp 283) provided in the fixing roller 284 and the external heating heater lamp 287 provided in the external heating roller 288, the fixing roller 284 is heated, and the pressurizing roller 286 is heated by the external heating roller 288. A heating temperature is controlled by turning on/off the heater according to surface temperatures of the fixing roller 284 and the external heating roller 288 that are detected by a thermistor (not-shown).

It is possible to use a metallic roller, for example, made of iron, aluminum or the like whose thickness is approximately 0.7 to 1.0 mm as the fixing roller 284. Additionally, the pressurizing roller 286 is composed of a roller with a three-layer structure in which an elastic layer is provided on an outer surface of a cored bar, and a release layer is formed on the outer surface of the elastic layer. For the cored bar, for example, a metal such as iron, stainless steel, aluminum or copper, or an alloy of these metals or the like, is used. Further, for the elastic layer, for example, silicon rubber is used. Moreover, for the release layer, for example, a fluorine resin such as a PFA (tetrafluoroethylene-perfluoroalkyl vinyl ether copolymer) or PTFE (polytetrafluoroethylene) is used.

It is possible to use a metallic roller, for example, made of aluminum or the like whose thickness is approximately 1.5 mm as the external heating roller 288, however, it is not limited to these materials.

<Structure of Cleaning Pad>

Figure 3A:
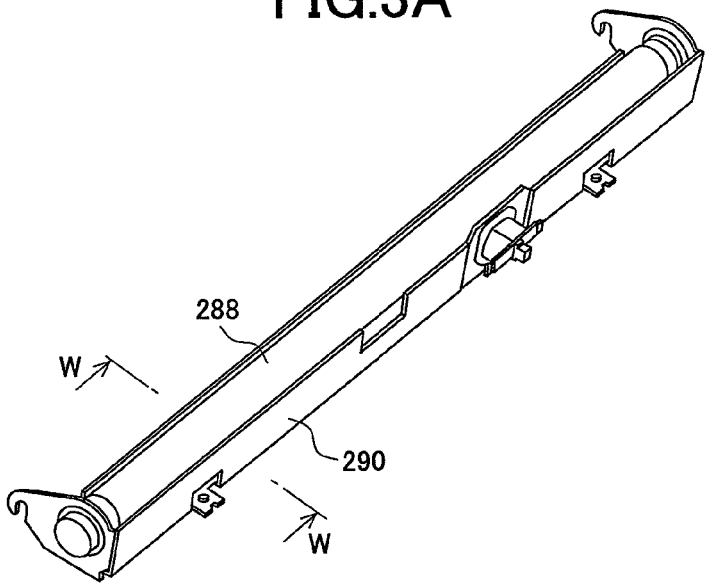
FIG. 3A to FIG. 3C are diagrams showing an example of a peripheral configuration of a cleaning pad and an external heating roller according to the present invention.
Figure 3B:
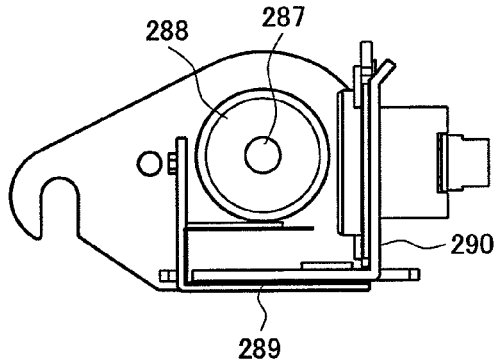
Figure 3C:
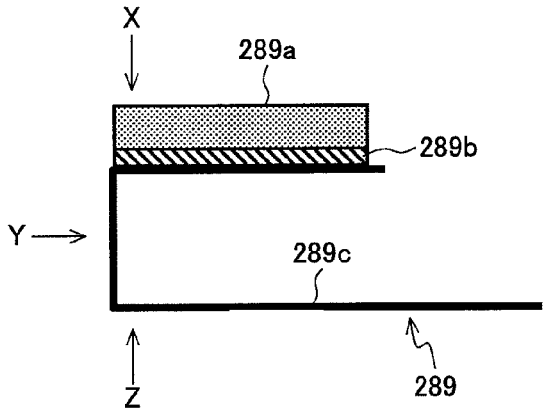

FIG. 3A to FIG. 3C are diagrams showing an example of a peripheral configuration of the cleaning pad 289 and the external heating roller 288 according to the present invention. FIG. 3A is a perspective top view of the peripheral configuration of the external heating roller 288, FIG. 3B is a diagram showing a WW' cross-section of the external heating roller 288 shown in FIG. 3A, and FIG. 3C is a diagram showing a configuration of the cleaning pad 289.

As shown in FIG. 3C, the cleaning pad 289 is, for example, formed by fixing a heat-resistant felt 289*a* as an example of a pad member, with use of a double-faced tape 289*b*, to a support member 289*c* composed of a leaf spring having a square-U-shaped cross-section (whose thickness is approximately 0.1 mm) made of stainless steel, phosphor bronze or the like. Then, as shown in FIG. 3B, the cleaning pad 289 is supported by the external heating frame 290 supporting the external heating roller 288 via the support member 289*c*. The heat-resistant felt 289*a* is, for example, composed of a material such as PTFE, and pressed on the surface of the external heating roller 288 by the support member 289*c*. An external heating roller unit composed of the external heating roller 288, the cleaning pad 289 and the like is incorporated into the fixing apparatus 28.

One of the distinctive features of the present invention is to appropriately suppress thermal expansion of a support member that constitutes a cleaning pad with respect to a thrust direction of a pressure-contacted roller that is pressed against the cleaning pad. For constituting in this manner, the fixing apparatus 28 includes the cleaning pad 289 that is pressed against at least one of the roller members (that is, pressure-contacted rollers) including a pair of rollers (fixing roller 284, pressurizing roller 286) to clean the surface of the pressure-contacted roller. The cleaning pad 289 is composed of the heat-resistant felt 289*a* that is an example of the pad member for cleaning the surface of the pressure-contacted roller, and the support member 289*c* that supports the heat-resistant felt 289*a* by pressing it against the surface of the pressure-contacted roller. Then, the support member 289*c* has a plurality of opening portions formed along the thrust direction of the pressure-contacted roller, and is configured so that an opening area per unit length of the support member 289*c* is larger at a center part of the support member 289*c* than that at both edge parts thereof.

Here, the case where the fixing apparatus 28 according to the present embodiment is provided with the external heating roller 288 that heats the pressurizing roller 286, and the cleaning pad 289 is pressed against the surface of the external heating roller 288 is described as an example, however, the cleaning pad 289 according to the present invention is similarly applicable also for the fixing roller 284 and/or the pressurizing roller 286.

Figure 4A:
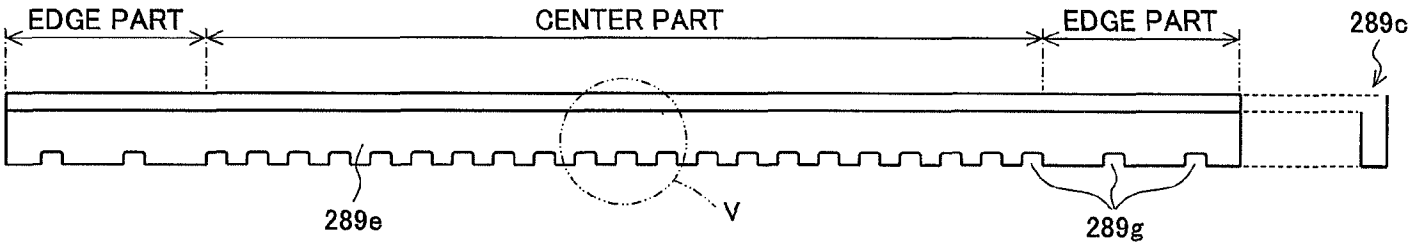
FIG. 4A to FIG. 4C are diagrams showing an example of a support member that constitutes the cleaning pad according to the present invention.
Figure 4B:
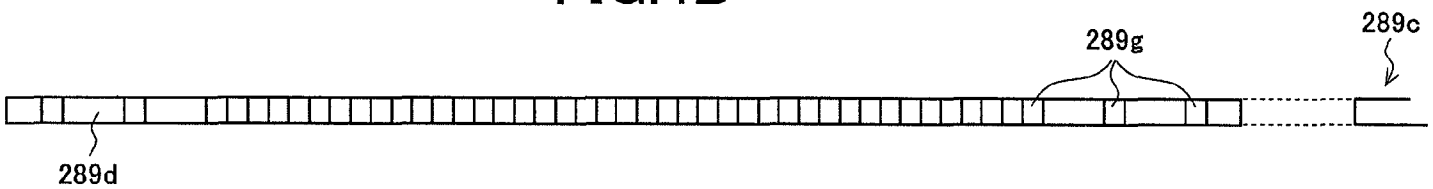
Figure 4C:
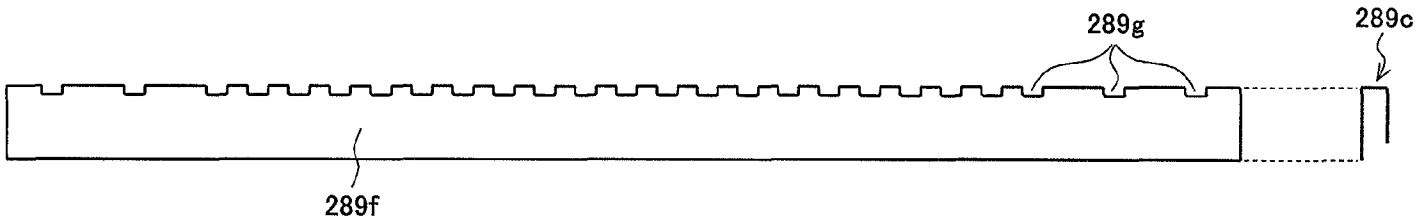
Figure 5:
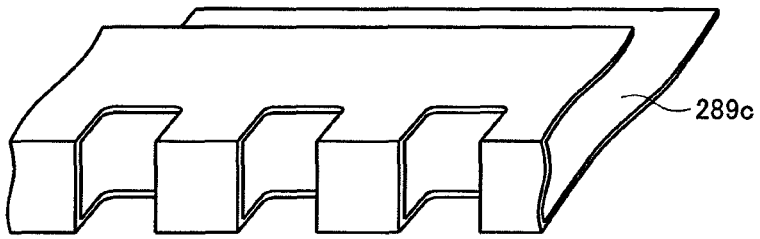
FIG. 5 is a perspective view of the support member.

FIG. 4A to FIG. 7C are diagrams showing an example of the support member 289*c* that constitutes the cleaning pad 289 according to the present invention. FIG. 4A is a diagram viewing the support member 289*c* from an X direction of FIG. 3C, FIG. 4B is a diagram viewing the support member 289*c* from a Y direction of FIG. 3C, and FIG. 4C is a diagram viewing the support member 289*c* from a Z direction of FIG. 3C. Additionally, FIG. 5 shows a state where a V part of the support member 289*c* shown in FIG. 4A is diagonally viewed from the rear. Hereinafter, the same holds for FIG. 6A to FIG. 6C and FIG. 7A to FIG. 7C.

In FIG. 4A to FIG. 7C, the support member 289*c* includes a bending portion 289*d* that is folded back so as to have a square-U-shaped cross-section, a pad member fixation portion 289*e* that is provided to be extended from the bending portion 289*d* and fixes the heat-resistant felt 289*a*, and a frame fixation portion 289*f* that is provided to be extended from the bending portion 289*d* and fixed to the external heating frame 290. In this manner, a leaf spring with a square-U-shaped cross-section is used as the support member 289*c*, so that it is possible to support the heat-resistant felt 289*a* by pressing it against the external heating roller 288. Note that, a shape of the cross-section of the support member 289*c* is not limited to a square-U shape, and may be a shape of the cross-section having a shape like a kana "he" character (L-shaped) as shown in FIG. 8A and FIG. 8B, and FIG. 9A and FIG. 9B that are described below.

As described above, the support member 289*c* has a plurality of the opening portions formed along the thrust direction of the external heating roller 288, and has a structure that the opening area per unit length of the support member 289*c* is larger at the center part of the support member 289*c* than that at the both edge parts thereof. The plurality of the opening portions are able to be formed in at least either of the bending portion 289*d* or the pad member fixation portion 289*e*. Specifically, for example, as shown in FIG. 4A to FIG. 4C, holes or slits 289*g* are formed as the opening portions in a long side direction of the bending portion 289*d*, and an interval of holes or slits 289*g* is arranged narrower at the center part of the support member 289*c* than that at the both edge parts thereof.

Figure 11:
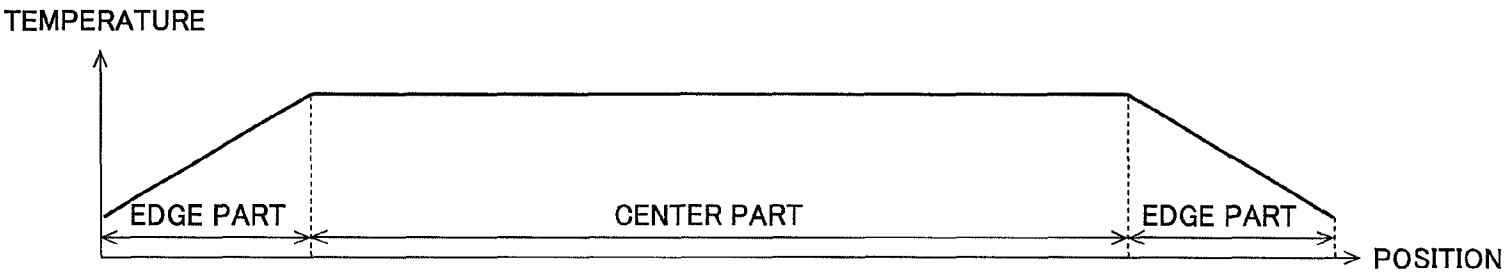
FIG. 11 is a diagram showing a distribution state of a surface temperature of the pressure-contacted roller that is pressed against the cleaning pad.

As explained in the above-described FIG. 11, since the pressure-contacted roller such as the external heating roller has a higher temperature at the center part than that at the both edge parts, a support member that constitutes a cleaning pad has a spot where thermal expansion is great (center part) and a spot where thermal expansion is small (both edge parts) occur in a long side direction due to such a temperature difference. On the other hand, the above mentioned structure, that is, with respect to a long side direction of the bending portion 289*d* of the support member 289*c*, it is possible to enhance a thermal expansion suppression effect at the center part where thermal expansion is great compared to that at the both edge parts, by narrowing the interval of the holes or the slits 289*g* at the center part and widening the interval of the holes or the slits 289*g* at the both edge parts. Thus, it is possible to effectively suppress the thermal expansion even when the thermal expansion of the support member 289*c* is greater at the center part than that at the both edge parts due to the temperature difference in the thrust direction of the external heating roller 288.

Figures 6A, 6B, 6C:
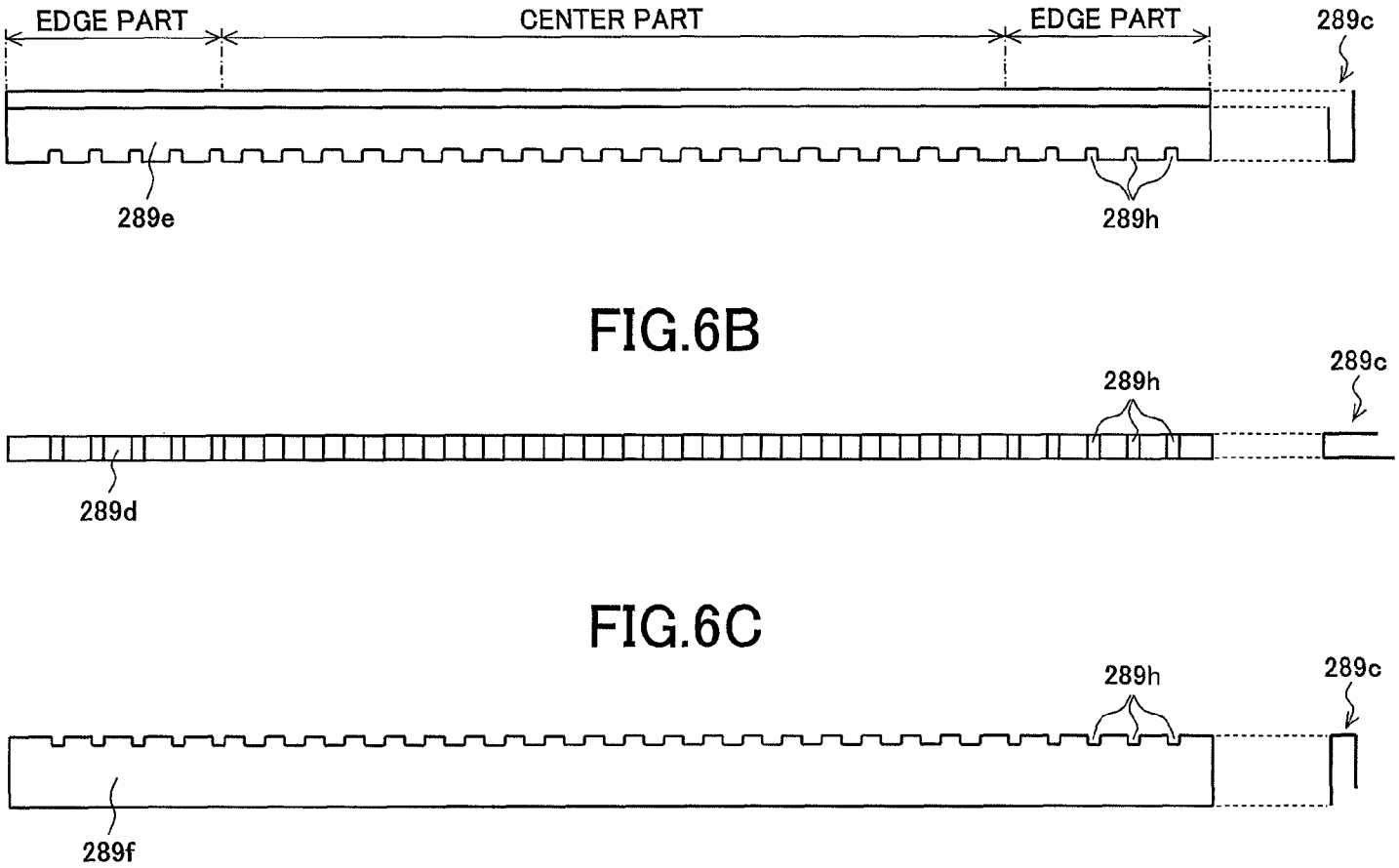
FIG. 6A to FIG. 6C are diagrams showing other example of the support member that constitutes the cleaning pad according to the present invention.

Further, as shown in FIG. 6A to FIG. 6C, holes or slits 289*h* are formed as the opening portions in the long side direction of the bending portion 289*d*, and the width of the hole or the slit 289*h* may be greater at the center part of the support member 289*c* than that at the both edge parts thereof. In the case of this example, it is possible to enhance the thermal expansion suppression effect at the center part where the thermal expansion is great compared to that at the both edge parts, as with examples of FIG. 4A to FIG. 4C by widening the width of the hole or the slit 289*h* at the center part and narrowing the width of the hole or the slit 289*h* at the both edge parts, with respect to the long side direction of the bending portion 289*d* of the support member 289*c*.

Note that, the configuration example of FIG. 4A to FIG. 4C is such that the width of the hole or the slit 289*g* is constant and the interval therebetween is changed at the center part and the both edge parts of the support member 289*c*, and the configuration example of FIG. 6A to FIG. 6C is such that the interval of the holes or the slits 289*h* is constant and the width is changed. Aside from these configuration examples, both the interval and the width of the hole or the slit may be arranged to be changed at the center part and the both edge parts of the support member 289*c*.

Figure 7A:
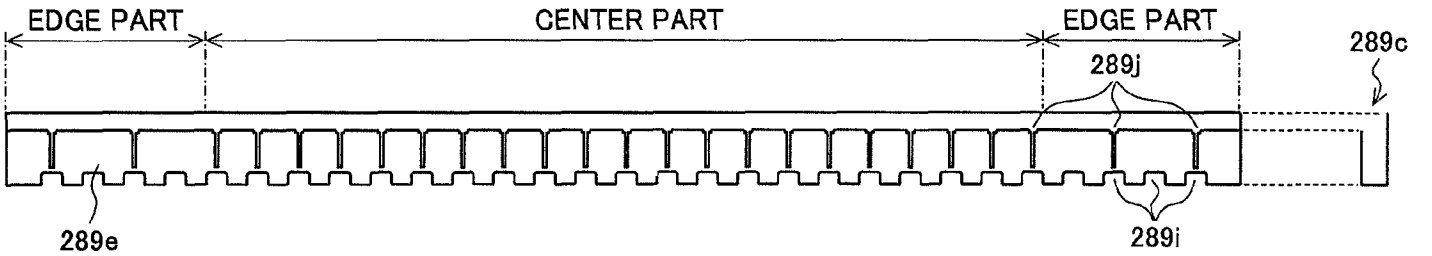
FIG. 7A to FIG. 7C are diagrams showing other example of the support member that constitutes the cleaning pad according to the present invention.
Figure 7B:
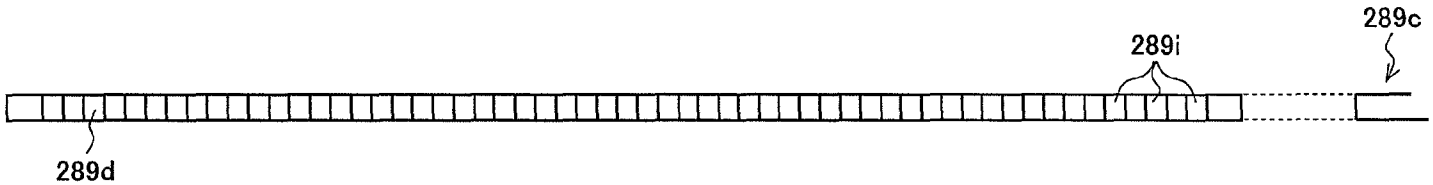
Figure 7C:
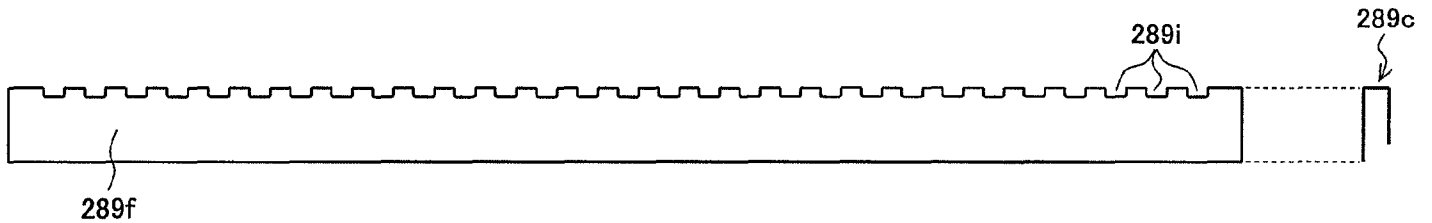

Furthermore, it may be configured as shown in FIG. 7A to FIG. 7C. In this case, holes 289*i* are formed at a regular interval and in a constant width as the opening portions in the long side direction of the bending portion 289*d*, as well as slits 289*j* are formed in a long side direction of the pad member fixation portion 289*e*. Then, it is configured so that the interval of the slits 289*j* is narrower at the center part of the pad member fixation portion 289*e* than that at the both edge parts thereof. That is, it is possible to enhance the thermal expansion suppression effect at the center part where thermal expansion is great compared to that at the both edge parts, as with FIG. 4A to FIG. 4C and FIG. 6A to FIG. 6C by narrowing the interval of the slits 289*j* at the center part and widening the interval of the slits 289*j* at the both edge parts, with respect to the long side direction of the pad member fixation portion 289*e* of the support member 289*c*. In the case of this example, since the holes 289*i* are formed at a regular interval and in a constant width even in the long side direction of the bending portion 289*d*, it is possible to obtain a greater thermal expansion suppression effect synergistically with the slits 289*j*.

Figure 8A:
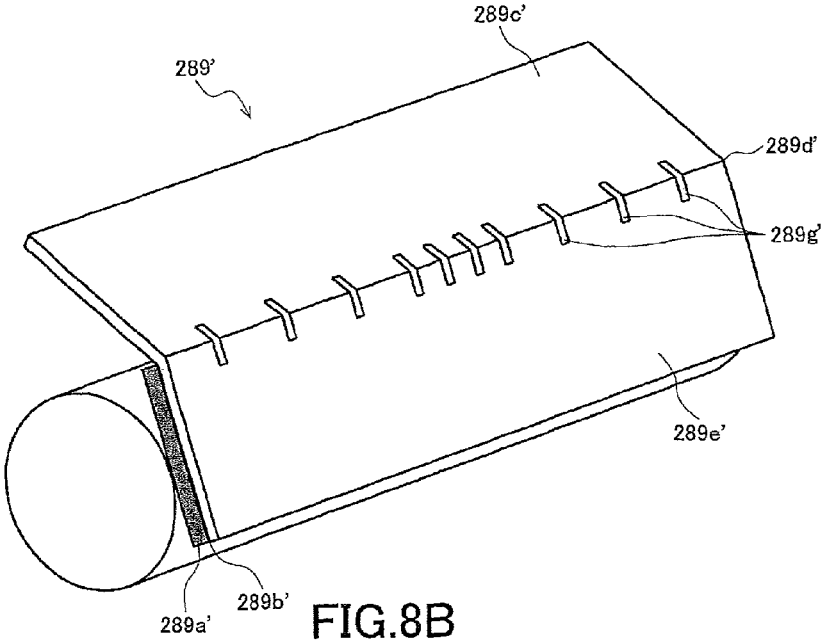
FIG. 8A and FIG. 8B are diagrams showing other configuration examples of the cleaning pad according to the present invention.
Figure 8B:
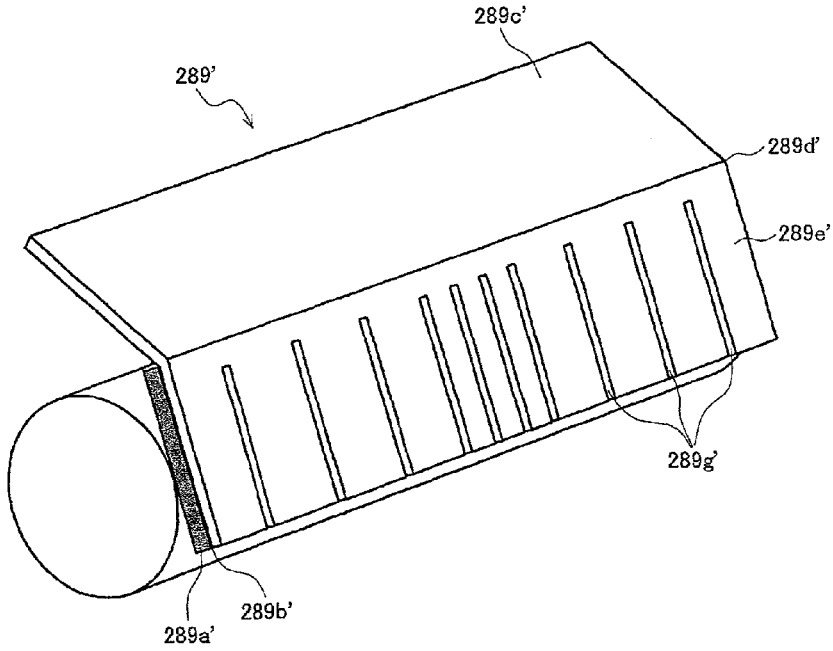

FIG. 8A and FIG. 8B are diagrams showing other configuration examples of a cleaning pad according to the present invention. In the diagrams, 289' denotes a cleaning pad. The cleaning pad 289' is configured such that heat-resistant felt 289*a'* is fixed, with use of a double-faced tape 289*d'*, to a support member 289*c'* composed of a leaf spring having a shape of a cross-section having a shape like a kana "he" character (L-shaped) to fix a heat-resistant felt 289*a'*. The support member 289*c'* includes a bending portion 289*d'* that is folded back in a shape of the cross-section having a shape like a kana "he" character (L-shaped), and a pad member fixation portion 289*e'* that is provided to be extended from the bending portion 289*d'* and fixes the heat-resistant felt 289*a'*.

An example of FIG. 8A shows a state where holes or slits 289*g'* are formed in a long side direction of the bending portion 289*d'*. Further, an example of FIG. 8B shows a state where slits 289*g'* are formed in a long side direction of the pad member fixation portion 289*e'*. Since, in both examples of FIG. 8A and FIG. 8B, the interval of the opening portions is narrowed at a center part of the support member 289*c'* and the interval of the opening portions is widened at the both edge parts, it is possible to enhance the thermal expansion suppression effect at the center part in which the thermal expansion is great compared to that at the both edge parts, as with the above-described examples of FIG. 4A to FIG. 7C.

Figure 9A:
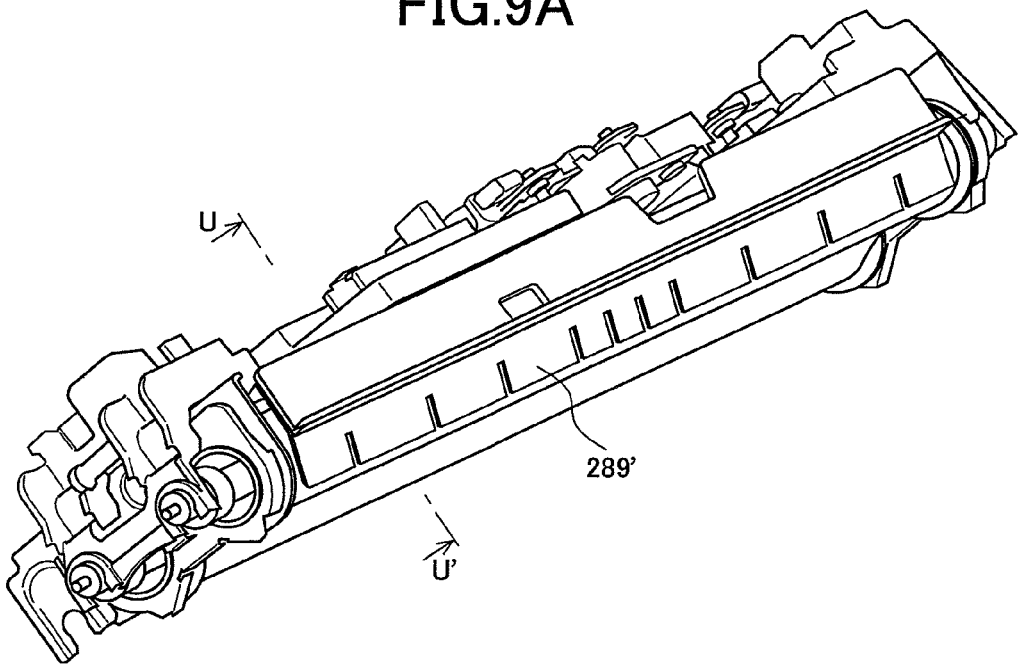
FIG. 9A and FIG. 9B are diagrams showing a state where the cleaning pad shown in FIG. 8B is pressed against a pressure-contacted roller.
Figure 9B:
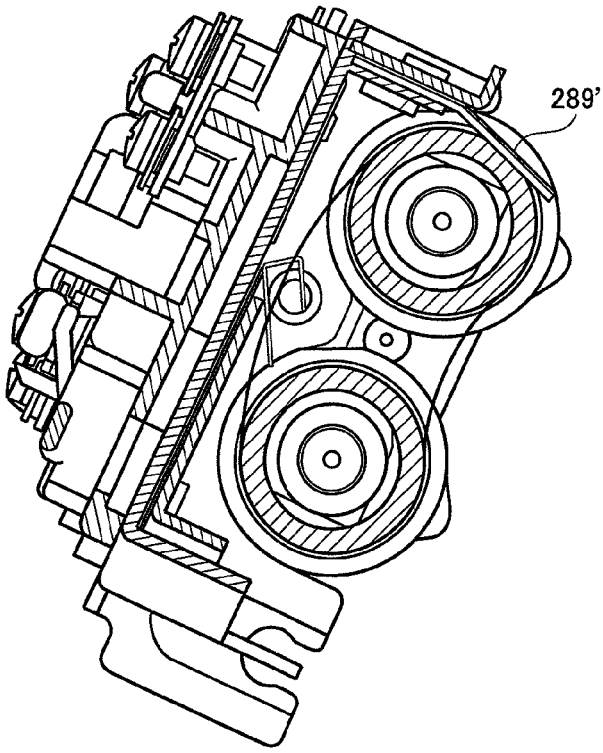
Figures 10A, 10B, 10C:
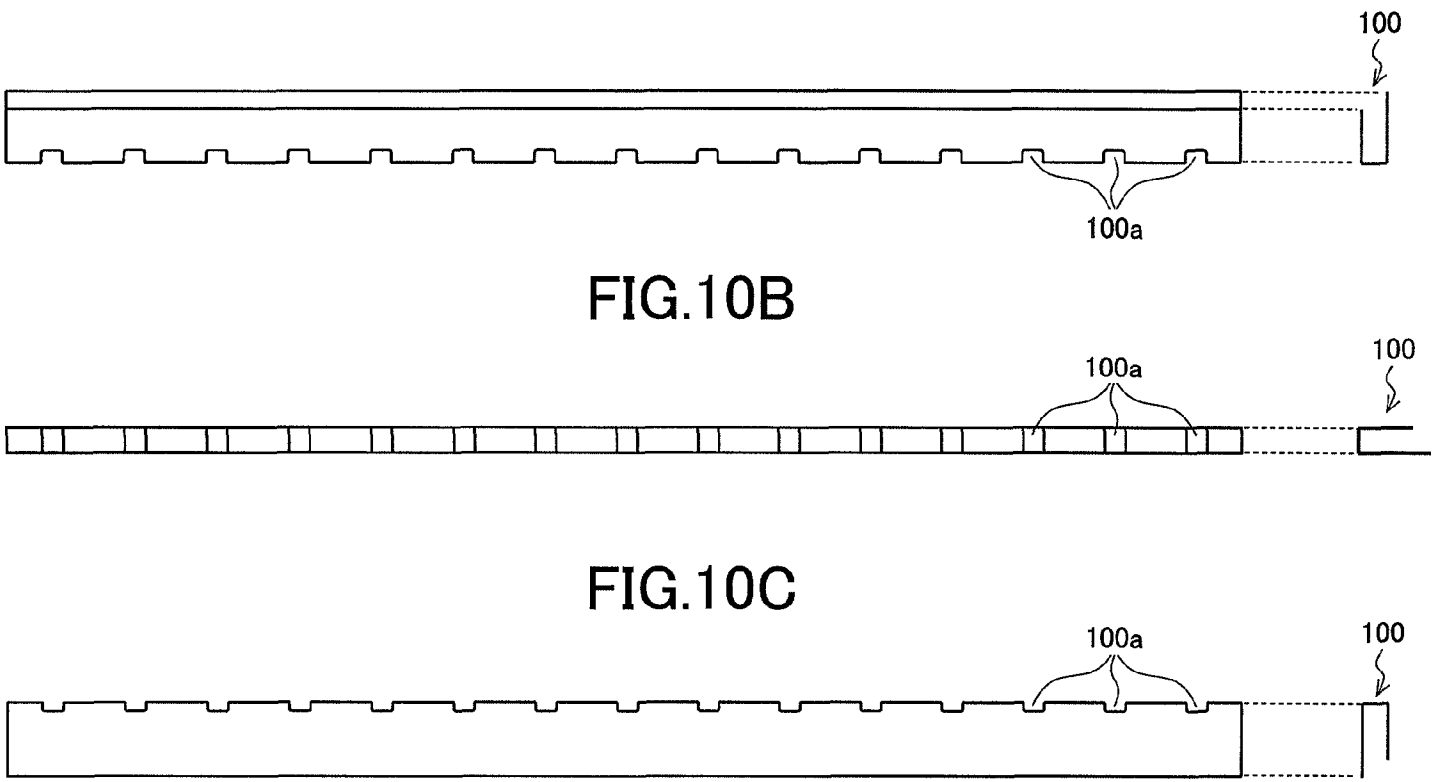
FIG. 10A to FIG. 10C are diagrams showing appearance of the support member that constitutes a conventional cleaning pad.

FIG. 9A and FIG. 9B are diagrams showing a state where the cleaning pad 289' shown in FIG. 8B is pressed against a pressure-contacted roller. FIG. 9A is an overall perspective view, and FIG. 9B is a diagram showing a UU' cross-section of FIG. 9A. Note that, the pressure-contacted roller shown in this example has a structure different from that of the external heating roller 288 explained in the above-described FIG. 2 and FIG. 3A to FIG. 3C, and is provided for heating a pressurizing roller and the like with an endless belt that is stretched out between two supporting rollers. Then, the surface of the endless belt is cleaned by the cleaning pad 289' formed in a shape of the cross-section having a shape like a kana "he" character (L-shaped).

According to the present invention, it is possible to uniform contact pressure of the cleaning pad to the pressure-contacted roller and stabilize the cleaning performance in the fixing apparatus, since the thermal expansion of the support member that constitutes the cleaning pad is appropriately suppressed and an occurrence of strain is prevented with respect to a thrust direction of the pressure-contacted roller that is pressed against the cleaning pad.

The invention claimed is:

1. A fixing apparatus that has a plurality of roller members including a pair of roller and heats a recording sheet on which an unfixed toner image is held by sandwiching it in a nip portion formed between the pair of rollers so that the unfixed toner image is melted to be fixed onto the recording sheet, comprising:

a cleaning pad that is pressed against at least one roller member among the plurality of roller members to clean a surface of the roller member, wherein the cleaning pad is composed of a pad member that cleans the surface of the roller member and a support member that supports the pad member by pressing it against the surface of the roller member, and the support member has a plurality of opening portions formed along a thrust direction of the roller member, and an opening area per unit length of the support member is larger at a center part of the support member than that at both edge parts thereof.

2. The fixing apparatus as defined in claim 1, wherein the plurality of roller members includes a fixing roller, a pressurizing roller that is coupled with the fixing roller, and an external heating roller that heats the pressurizing roller, and the cleaning pad is pressed against at least one roller of the fixing roller, the pressurizing roller, and the external heating roller.

3. The fixing apparatus as defined in claim 1, wherein the plurality of the opening portions includes holes or slits, and an interval of the holes or the slits is narrower at a center part of the support member than that at both edge parts thereof.

4. The fixing apparatus as defined in claim 1, wherein the plurality of the opening portions includes holes or slits, and a width of the hole or the slit is wider at a center part of the support member than that at both edge parts thereof.

5. The fixing apparatus as defined in claim 1, wherein the support member includes a bending portion that is folded back so as to have a square-U-shaped cross-section or a cross-section having a shape like a kana "he" character (L-shaped), and the plurality of the opening portions are formed in a long side direction of the bending portion.

6. The fixing apparatus as defined in claim 1, wherein the support member includes the bending portion that is folded back so as to have a square-U-shaped cross-section or a cross-section having a shape like a kana "he" character (L-shaped) and a pad member fixation portion that is provided to be extended from the bending portion and fixes the pad member, and the plurality of the opening portions includes holes that are formed at a regular interval and in a constant width in the long side direction of the bending portion and slits that are formed in a long side direction of the pad member fixation portion, and an interval of the slits is narrower at a center part of the pad member fixation portion than that at both edge parts thereof.

7. The fixing apparatus as defined in claim 1, wherein the support member includes the bending portion that is folded back so as to have a square-U-shaped cross-section or a cross-section having a shape like a kana "he" character (L-shaped) and the pad member fixation portion that is provided to be extended from the bending portion and fixes the pad member, and the plurality of the opening portions includes slits formed in the long side direction of the pad member fixation portion, and an interval of the slits is narrower at a center part of the pad member fixation portion than that at both edge parts thereof.

8. An image forming apparatus, comprising:
the fixing apparatus as defined in claim 1.

* * * * *